US010253383B2

(12) United States Patent
Lu et al.

(10) Patent No.: US 10,253,383 B2
(45) **Date of Patent: *Apr. 9, 2019**

(54) NANOSTRUCTURED-LATTICES PRODUCED BY SURFACE MECHANICAL ATTRITION TREATMENT METHOD

(71) Applicant: City University of Hong Kong, Hong Kong (HK)

(72) Inventors: Jian Lu, Hong Kong (HK); Phu Son Mai, Ha Noi (VN); Chun Sheng Wen, Hong Kong (HK)

(73) Assignee: City University of Hong Kong, Hong Kong (CN)

( * ) Notice: Subject to any disclaimer, the term of this patent is extended or adjusted under 35 U.S.C. 154(b) by 828 days.

This patent is subject to a terminal disclaimer.

(21) Appl. No.: 14/411,102

(22) PCT Filed: Aug. 1, 2014

(86) PCT No.: PCT/CN2014/083598

§ 371 (c)(1),
(2) Date: Dec. 24, 2014

(87) PCT Pub. No.: WO2015/014319

PCT Pub. Date: Feb. 5, 2015

(65) Prior Publication Data

US 2016/0258033 A1 Sep. 8, 2016

Related U.S. Application Data

(60) Provisional application No. 61/958,644, filed on Aug. 2, 2013.

(51) Int. Cl.
*C21D 7/06* (2006.01)
*C21D 10/00* (2006.01)

(52) U.S. Cl.
CPC ..... *C21D 7/06* (2013.01); *C21D 10/00* (2013.01); *C21D 2201/03* (2013.01);
(Continued)

(58) Field of Classification Search
None
See application file for complete search history.

(56) References Cited

U.S. PATENT DOCUMENTS 7,147,726 B2 12/2006 Lu et al.
7,300,622 B2 11/2007 Lu et al.
(Continued)

FOREIGN PATENT DOCUMENTS

CN 1699617 A 11/2005
CN 101925681 A 12/2010
(Continued)

OTHER PUBLICATIONS

Lu (Materials Science and Engineering A, 2004, vol. 375-377, p. 38-45).*
International search report and written opinion of PCT application No. PCT/CN2014/083598 issued from the International Search Authority dated Oct. 27, 2014.
Fleck N. A., et al., Micro-architectured materials: past, present and future, Proc. R. Soc. A (2010) 466, 2495-2516.
(Continued)

*Primary Examiner* — Xiaowei Su
(74) *Attorney, Agent, or Firm* — Renner Kenner Greive Bobak Taylor & Weber

(57) ABSTRACT

The present invention is about the design and manufacturing method of constructing nano-structured lattices. The design of the four periodic two-dimensional lattices (hexagonal, triangulated, square and Kagome) is described; and the process of making nano-structured lattices is outlined in the present invention.

8 Claims, 19 Drawing Sheets

(52) U.S. Cl.
CPC ..... *C21D 2211/00* (2013.01); *C21D 2221/00* (2013.01); *C21D 2261/00* (2013.01)

(56) References Cited

U.S. PATENT DOCUMENTS

| | | | | |
|---|---|---|---|---|
| 7,691,211 | B2 | 4/2010 | Lu et al. | |
| 9,517,545 | B2 * | 12/2016 | Lu | B24C 5/005 |
| 9,809,893 | B2 * | 11/2017 | Lee | C25D 11/005 |
| 2010/0101686 | A1 | 4/2010 | Lu et al. | |
| 2011/0146361 | A1 * | 6/2011 | Davidson | A61F 2/2418 72/53 |
| 2011/0252850 | A1 | 10/2011 | Lu | |

FOREIGN PATENT DOCUMENTS

| | | | |
|---|---|---|---|
| CN | 102560508 | A | 7/2012 |
| CN | 103114185 | A | 5/2013 |
| CN | 103160664 | A | 6/2013 |

OTHER PUBLICATIONS

Chan H. L., et al., Optimization of the strain rate to achieve exceptional mechanical properties of 304 stainless steel using high speed ultrasonic surface mechanical attrition treatment, Acta Materialia 58 (2010) 5086-5096.

Chen A. Y., et al., The influence of strain rate on the microstructure transition of 304 stainless steel, Acta Materialia 59 (2011) 3697-3709.

Gibson, L.J., Ashby, M.F., 1997. Cellular Solids: Structure and Properties, second edition, Cambridge University Press, pp. 26-38.

Lu K., et al., Surface Nanocrystallization (SNC) of Metallic Metrials-Presentation of the Concept behind a New Approach, J. Mater. Sci. Technol., vol. 15 No. 3, 1999.

Lu K., et al., Nanostructured surface layer on metallic materials induced by surface mechanical attrition treatment, Materials Science and Engineering A 375-377 (2004) 38-45.

Romijn N.E.R, et al., The fracture toughness of planar lattices: Imperfection sensitivity, Journal of the Mechanics and Physics of Solids 55 (2007) 2538-2564.

* cited by examiner

NANOSTRUCTURED-LATTICES PRODUCED BY SURFACE MECHANICAL ATTRITION TREATMENT METHOD

CROSS-REFERENCE TO RELATED APPLICATIONS

This application is a national phase patent application of international patent application number PCT/CN2014/083598 filed Aug. 1, 2014 claiming priority from a U.S. provisional patent application Ser. No. 61/958,644 filed Aug. 2, 2013, and the disclosure of which are incorporated herein by reference in their entirety.

FIELD OF THE INVENTION

The present invention relates to nanostructured lattices, and methods for fabricating said nanostuctured lattices, and more particularly relates to nanostructures lattices produced by surface mechanical attrition treatment method.

BACKGROUND

Lattices are commonly used as light-weight structures due to their inherent cavities. Examples of these structures are truss bridges, stadiums' framework roofs and telescope supporters. In the simple two-dimensional (2D) space, the common periodic lattices are constructed from the geometrical shapes of regular polygons such as equilateral triangle, square and regular hexagon. See FIG. 1 (Ashby and Gibson, 1997; Fleck et al., 2010).

Nevertheless, in some cases, the mechanical properties of the lattices such as tensile strength, hardness, or ductility are not able to fulfill the requirements in certain applications.

Consequently, there is an unmet need for lattices, which provide advanced mechanical properties with light weight for satisfying the requirements in myriad applications.

SUMMARY OF THE INVENTION

Accordingly, an aspect of the presently claimed invention is to provide a nano-structured lattice produced by a surface mechanical attrition treatment (SMAT) method.

In accordance with an embodiment of the presently claimed invention, a nano-structured lattice generated by surface mechanical attrition treatment, comprising: a plurality of bar members; and one or more holes embedded inside the nano-structured lattice; wherein one or more of the bar members comprise one or more nodes for connecting one or more other bar members; and wherein one or more of the bar members are partly or completely treated by the SMAT.

The lattice can be a hexagonal lattice, triangulated lattice, square lattice, or Kagome lattice. The coarse grain size at surface of the bar members is reduced to form at least one nano-structured layer with grain size in nanometer after being treated by the SMAT.

In accordance with an embodiment of the presently claimed invention, the bar members are completely treated by the SMAT.

In accordance with an embodiment of the presently claimed invention, the lattice is a square lattice, and the treated bar members are horizontal bars for being subjected to an applied loading along a horizontal axis of the square lattice, or are partly treated at their end portion within a circle around the node.

In accordance with an embodiment of the presently claimed invention, the lattice is a kagome lattice, and the treated bar members are horizontal bars for being subjected to a maximum axial stress, or diagonal bars for being subjected to a maximum axial stress.

In accordance with an embodiment of the presently claimed invention, the SMAT method comprises impacting surface of the solid material partly or completely with one or more projectiles in an acoustic isolation chamber. The projectiles are actuated by a vibration generator.

The present invention is able to provide a nanostructured lattice with light weight but high strength and hardness. The nanostructured lattice can be conveniently designed with various geometrical sizes and masses. Consequently, these can be developed as light-weight, high-strength and multi-functional structures/materials, which can potentially provide a wide range of engineering applications such as vehicle covers, bridges, building roofs, floors and walls.

BRIEF DESCRIPTION OF THE DRAWINGS

Embodiments of the present invention are described in more detail hereinafter with reference to the drawings, in which.

DETAILED DESCRIPTION OF PREFERRED EMBODIMENTS

In the following description, nanostructured lattices, and the corresponding embodiments of the fabrication methods are set forth as preferred examples. It will be apparent to those skilled in the art that modifications, including additions and/or substitutions, may be made without departing from the scope and spirit of the invention. Specific details may be omitted so as not to obscure the invention; however, the disclosure is written to enable one skilled in the art to practice the teachings herein without undue experimentation.

The present invention is the combination of lattice topologies and nano-structured materials induced by the SMAT process. On one hand, the SMAT method increases significantly the strength of metallic materials. On the other hand, lattice topologies possess variety in designing the mass and geometries of these structures. As combined, the SMAT-lattice structures are much stronger, and can be of various geometrical sizes and masses.

The present invention concerns with the design and manufacturing of lattice architectures from the nano-structured materials produced by SMAT process. The methodology of generating solid nano-structured materials by SMAT process is outlined in the prior art, U.S. Pat. No. 7,691,211. This method has been proved to increase significantly the strength of metallic materials such as stainless steel sheets, see Chan et al., (2010) and Chen et al., (2011).

Figure 1:
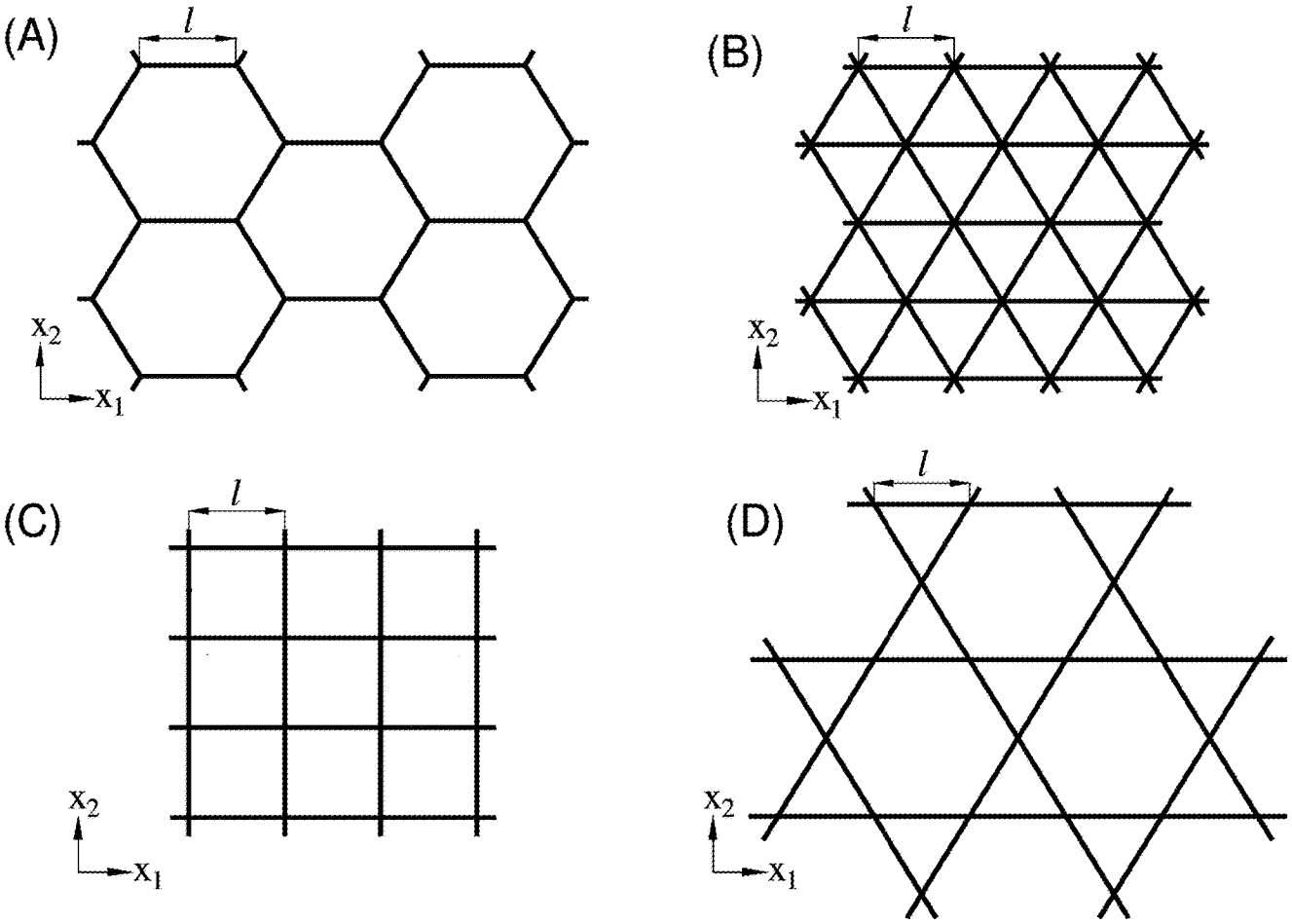
FIG. 1 (Prior Art)
FIG. 1 shows different shapes of lattices in a prior art.
Figure 2:
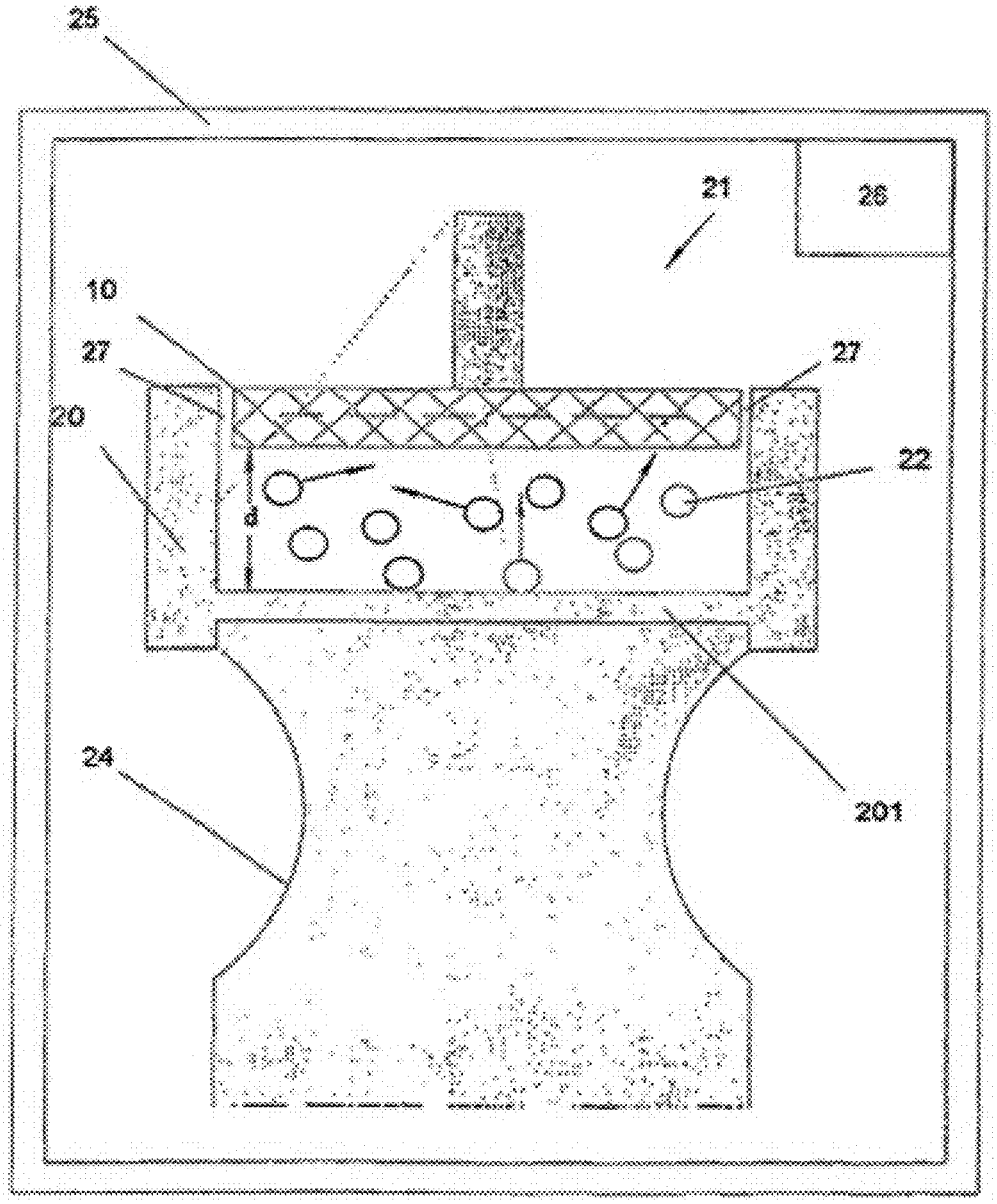
FIG. 2 (Prior Art)
FIG. 2 shows a schematic diagram of a device for generating nanostructure in a SMAT process in a prior art.

Nano-structured materials have been effectively generated by the surface mechanical attrition treatment method, see Lu and Lu (1999 & 2004) and U.S. Pat. No. 7,691,211. In the SMAT process, a number of spherical projectiles are actuated by a vibration generator to impact the material surface at various angles, as schematically shown in FIG. 2. Thus, the coarse grain sizes at this surface are reduced to form a nano-structured layer with grain size of several tens of nanometers. As a result, the macroscopic mechanical properties of the material such as strength and hardness are significantly increased (Chan et al., 2010; Chen et al., 2011).

FIG. 2 represents a diagram of a SMAT device for generating nanostructures using ultrasound in the prior art, U.S. Pat. No. 7,691,211, which can be used to implement the present invention. In this embodiment of the prior art, the SMAT device comprises an acoustic isolation chamber 25. The sonotrode 24 is joined to a bowl 20 whose top opening is blocked by a device 21 for placing the piece 10 to be treated under stress. The device 21 is mounted relative to the bowl 20 on means that make it possible to adjust the distance between the surface exposed to the bombardment and the bottom of the bowl 201, which constitutes the emission surface of the balls 22. A space 27 can be provided between the piece to be treated or its support and the bowl 20. The principle of setting the balls in motion using ultrasound is to set the balls 22 in motion by means of an ultrasonic generator 24 operating at a given frequency, which communicates a movement of given amplitude and speed to the bowl 20. The amplitude of the movement of the sonotrode could be chosen so as to be from a few microns to a few hundred microns. The balls 22 draw their energy from the movement of the bowl and hit the surface of the piece 10 a large number of times, at variable and multiple incident angles, creating with each impact a plastic deformation of the grains constituted by an agglomerate of molecules of the material or the alloy, in any direction. A ball that loses its energy in contact with the piece bounces off the walls of the bowl so as to acquire a new speed in a direction which, seen from the piece, seems random but is determined by physical laws. Diffusing or vaporizing means 26 are disposed in the sealed acoustic chamber 25, making it possible to perform one or more of the chemical or thermochemical treatments described below, possibly associated with means for heating the chamber or the piece.

In this invention, holes of regular polygonal shapes (triangle, square or hexagon) are embedded inside the solid nano-structured materials in uniform and periodic patterns in order to reduce the overall mass and to create light-weight structures. There are four types of the lattice designs as exhibited in FIG. 3. These are: hexagonal (FIG. 3A), triangulated (FIG. 3B), square (FIG. 3C), and Kagome (FIG. 3D) lattices, respectively.

Figure 3A:
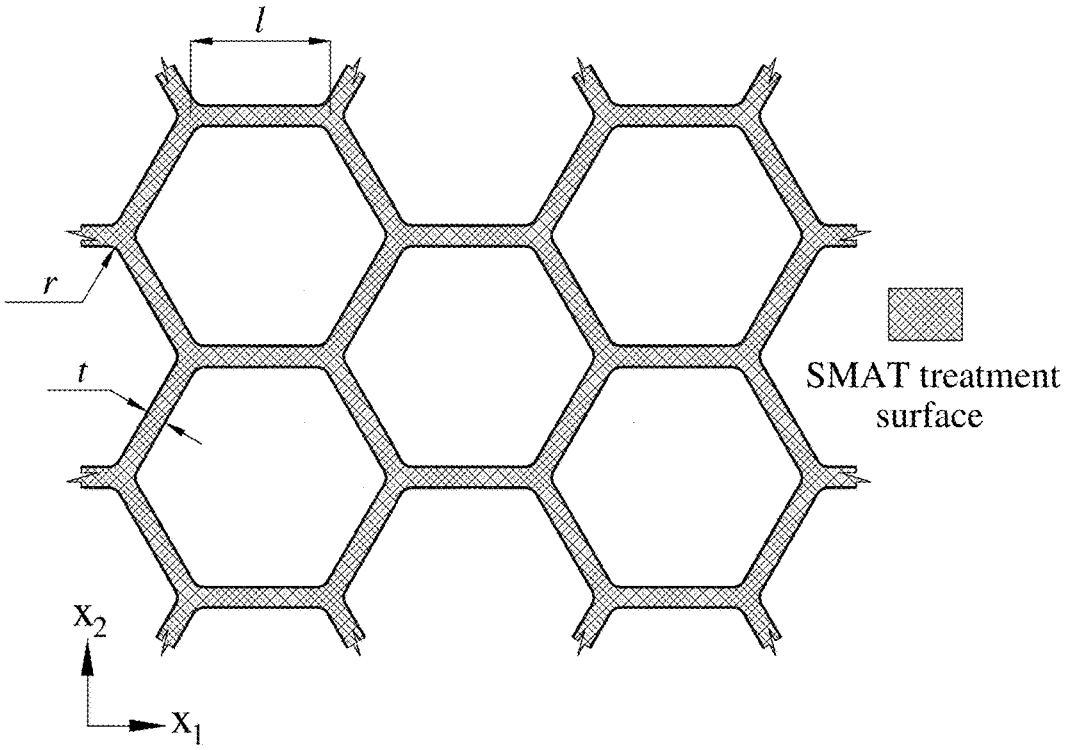
FIG. 3A-D shows four types of nanostructured lattices according to various embodiments of the presently claimed invention.

FIG. 3A presents the design of the hexagonal honeycomb lattice. This lattice only has identical holes of regular hexagonal shapes. These holes are located in a periodic pattern such that the lattice can uniformly extended in the two principal $x_1$- and $x_2$-axes of the 2D space.

Figure 3B:
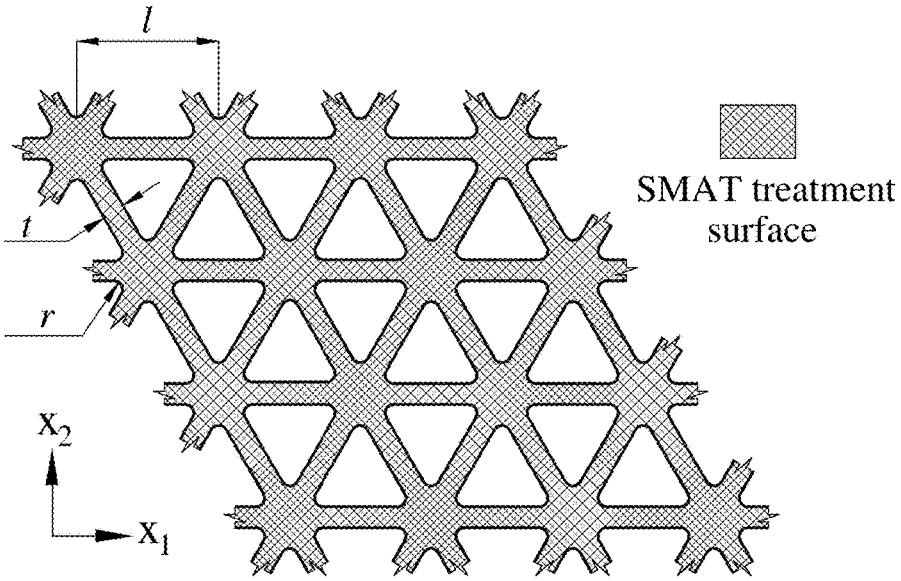

FIG. 3B presents the design of the triangulated lattice. This lattice only has identical holes of equilateral triangular shapes. These holes are also arranged in a periodic pattern along the two principal $x_1$- and $x_2$-axes of the planar space.

Figure 3C:
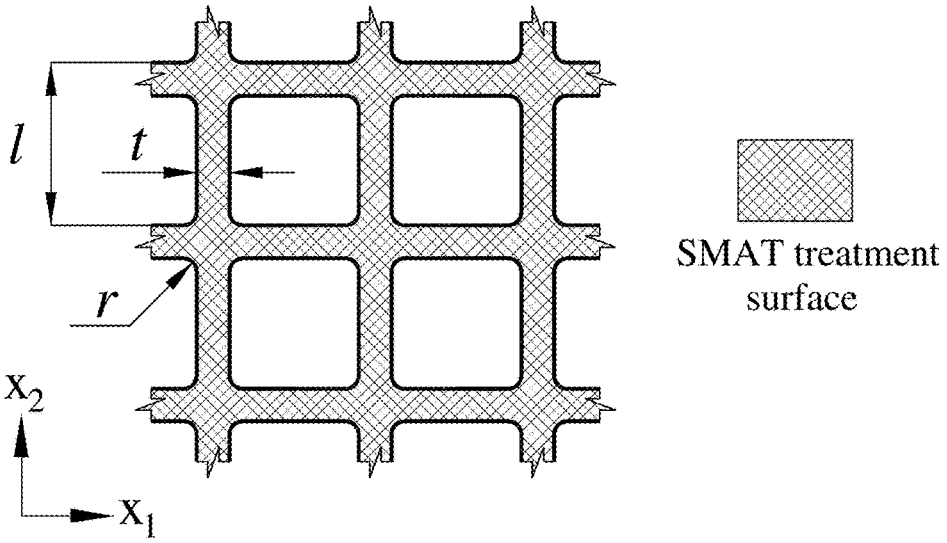

FIG. 3C presents the design of the square lattice. This lattice only has identical holes of square shapes. These holes are periodically located along the two principal $x_1$- and $x_2$-axes of the planar space.

Figure 3D:
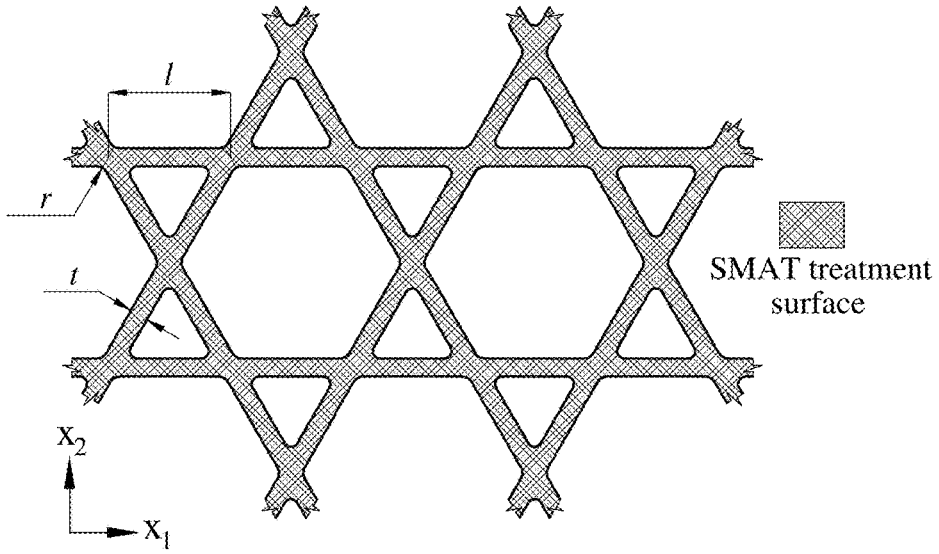

FIG. 3D presents the design of the Kagome lattice. This lattice has identical holes of regular hexagonal and equilateral triangular shapes. These holes are arranged in a periodic pattern such that the lattice can uniformly extended in the two principal $x_1$- and $x_2$-axes of the 2D space.

For each type of the lattice, the remaining solid framework of bars is characterized by three geometrical parameters (t, l, r): l is the designed central-line length of each bar member in the lattice; t is the designed thickness of each bar member of the lattice; r is the designed radius of the blunting round-off at each nodal corner of the lattice. This round-off is designed to reduce the stress concentration at the nodal positions of the lattice.

The mass of each lattice depends mainly upon t and l, and can be varied by changing the values of these two parameters. For example, the lattice can be considered as being thin (low mass) if the ratio $l/t \geq 30$, while it can be thick (high mass) if $4 \leq l/t \leq 10$. The designed ratio of t/r is in the range of 1 to 2.

According to an embodiment of the presently claimed invention, the manufacturing method of nano-structured lattices is shown as follows. Firstly, the initial solid material is treated by SMAT process to produce nano-structured material following the prior art, U.S. Pat. No. 7,691,211. Secondly, the type of the lattice is chosen, and the values of the three parameters (l, t, r) are designed in order to determine the dimensions of the holes, which will be removed from the solid SMAT material. The three designed values of (l, t, r) are also used to construct the drawing of the lattice for programming in the CNC water-cutting machine. Finally, the designed holes are wire-cut off from the solid nano-structured material by the CNC machine, and the nano-structured lattice is consequently achieved.

In the present invention, nano-structured materials produced by surface mechanical attrition treatment method are particularly explored for two periodic lattice topologies: square and Kagome. Selected SMAT strategies are applied to bar members in the unit cell of each topology considered. The maximum axial stress in these bars is calculated as a function of the macroscopic in-plane principal stresses. A simple yield criterion is used to determine the elastic limit of the lattice with each SMAT strategy, and the relative merits of the competing strategies are discussed in terms of the reinforced yield strength and the SMAT efficiency. Experiments of selected SMAT strategies on both square and Kagome lattices made from stainless steel sheets are performed to assess the analytical predictions for the loading case of uni-axial tension.

Experiments on the uni-axial tension of square and Kagome lattices treated with SMAT are shown as follows.

Experimental tests have been performed to explore the strengthening effect of SMAT method upon the two lattices considered. The specimens of square and Kagome topologies arranged in selected directions were manufactured and treated with SMAT. These lattice samples were subjected to uni-axial tension test in turn, and the SMAT effect was assessed for each lattice topology.

Square lattices: 0/90° versus ±45°, are tested and studied as follows.

A series of SMAT strategies applied to each unit cell of the square lattice is introduced as follows.

(i) Strategy N: no SMAT; this is for comparison purposes.

Figure 4:
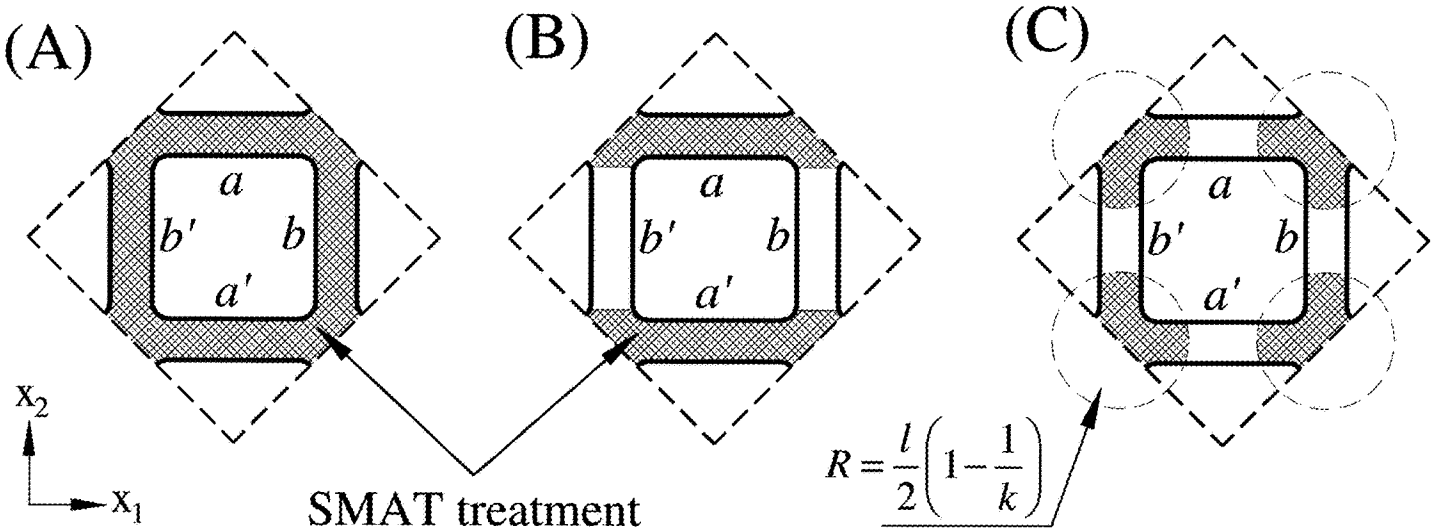
FIGS. 4A-C show SMAT for each unit cell of the square lattice with strategy AI, strategy AII, and strategy AIII according to an embodiment of the presently claimed invention.

(ii) Strategy AI: all bar members in the lattice are completely treated with SMAT, see FIG. 4A. This strategy is aimed for any in-plane loadings.

(iii) Strategy AII only two horizontal bars a and a' are SMAT-treated, see FIG. 4B. The strategy is for the loading case of uni-axial tension along the $x_1$-axis of the square lattice. In this case, the two bars a and a' are directly subjected to the applied load while the other two bars b and b' carry negligible forces.

(iv) Strategy AIII: the SMAT is applied to the end portions of the bars within a circle of radius $R=(1-1/k)l/2$ around each node, see FIG. 4C. This is for the case of uni-axial tension in the ±45° directions of the square lattice. Under this load, all the bars undergo bending and the maximum stresses occur at the vicinity of the bar ends. Thus, applying SMAT to these areas can be most efficient.

Figure 5:
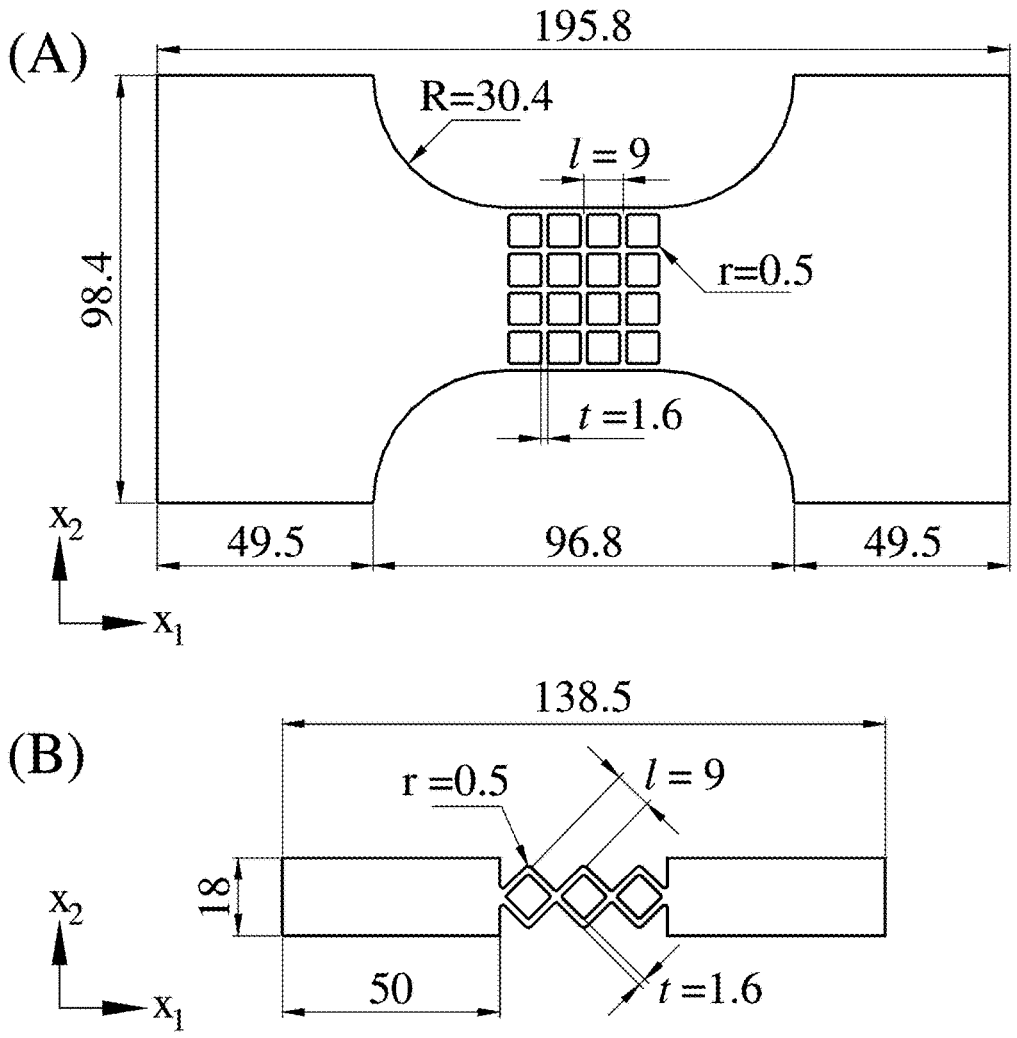
FIGS. 5A-B show geometry of the experimental specimens with a 0/90° square lattice, and a ±45° square lattice respectively according to an embodiment of the presently claimed invention.

Geometries of tensile dog-bone specimens are shown in FIG. 5A for the 0/90° square lattice and in FIG. 5B for the ±45° square lattice, respectively. Each bar member in the square lattice is of length l=9 mm and width t=1.6 mm, giving the relative density $\bar{\rho}=2t/l=0.35$.

Figure 6:
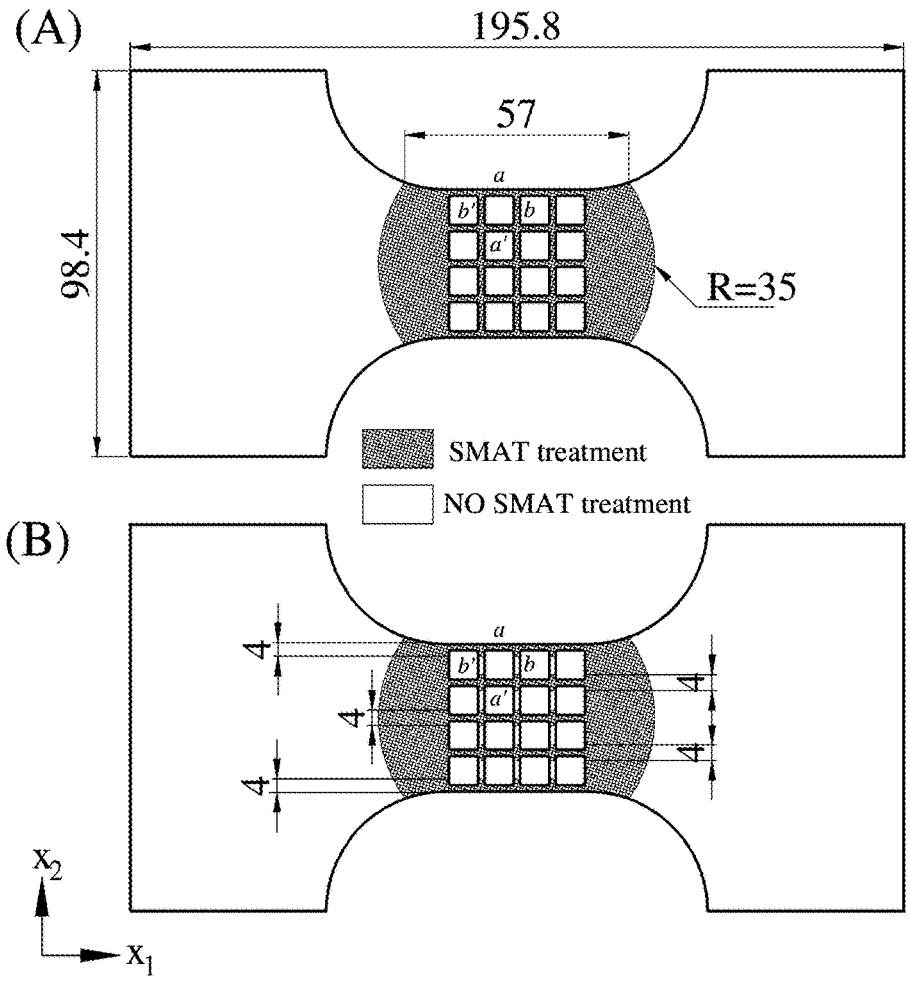
FIGS. 6A-B show two 0/90° square lattices with fully SMAT—strategy AI, and partly SMAT—strategy AII respectively according to an embodiment of the presently claimed invention.
FIGS. 6C-D show two ±45° square lattices with fully SMAT—strategy AI, and partly SMAT—strategy AIII respectively according to an embodiment of the presently claimed invention.
Figure 6:
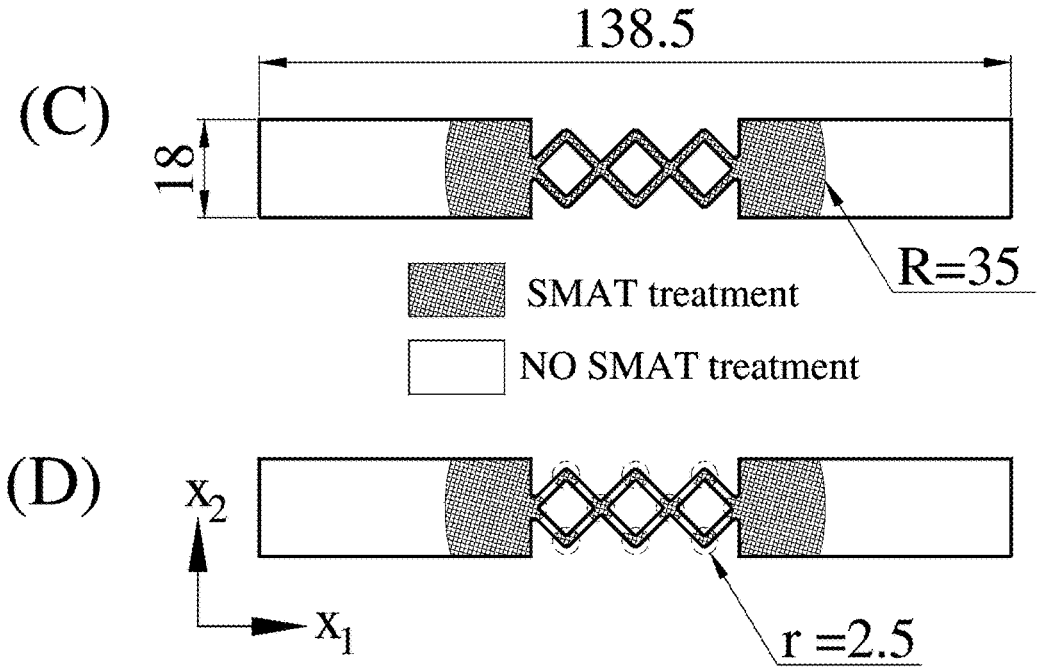

Three identical 0/90° square lattice plates were manufactured for three cases considered: no SMAT—strategy N, fully SMAT—strategy AI, and partly SMAT—strategy AII. The SMAT-treated surface areas of strategies AI and AII are shown in FIGS. 6A and 6B, respectively. Likewise, the ±45° square lattice specimens were made for three cases: no SMAT—strategy N, fully SMAT—strategy AI, and partly SMAT—strategy AIII. The SMAT areas are shown in FIG. 6C for strategy AI, and in FIG. 6D for strategy AIII.

All samples were cut from AISI 304 stainless steel sheets of thickness d=1 mm. The manufacturing route is as follows. First, steel sheets were wire-cut into three identical dog-bone plates for the 0/90° square lattice, and into three identical rectangular plates for the ±45° square lattice. For the no SMAT specimens, the central areas of the plates were wire-cut into the designed patterns, recall FIGS. 5A and 5B. For the fully SMAT specimens, the central areas were first treated with SMAT process for 3 minutes, then wire-cut into the designed geometries. The partly SMAT specimens were manufactured in the same route; however during the SMAT process, cloths were used to cover the untreated areas.

Figure 7A:
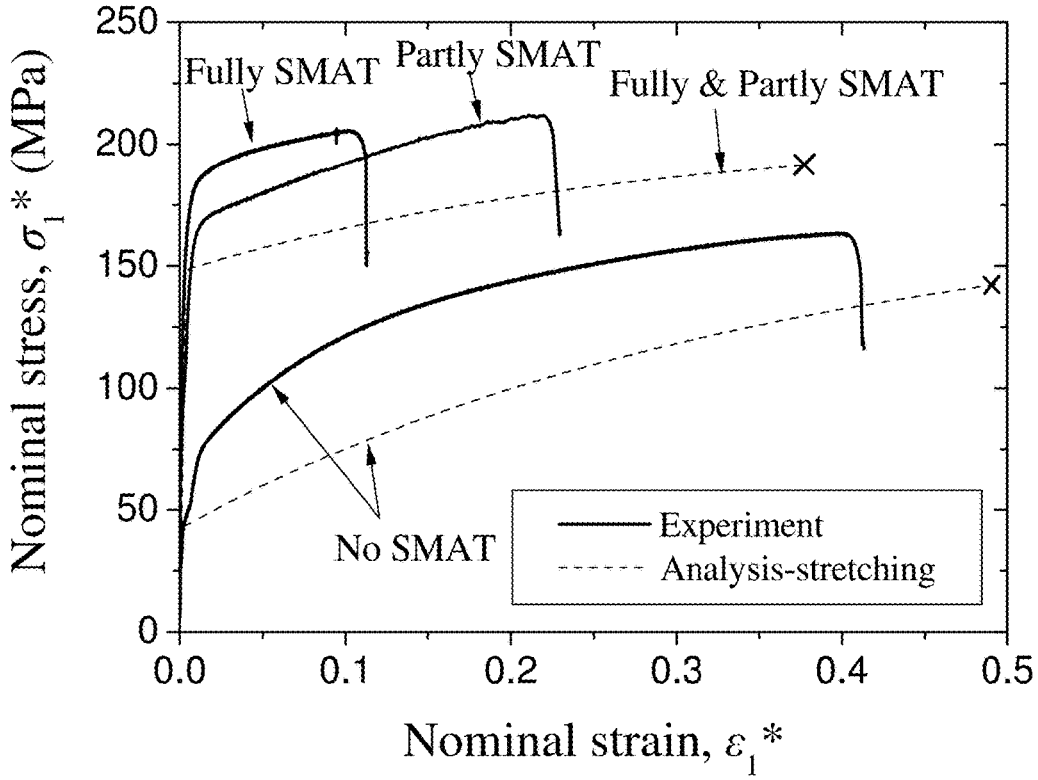
FIGS. 7A-B shows measured responses of the 0/90° square lattices and the ±45° square lattices respectively with respect to the square lattices of FIG. 6A-D.

The manufactured samples were in turn subjected to the quasi-static tensile test (along the $x_1$-axis shown in FIG. 5) at a strain rate of $\dot{\varepsilon}=10^{-4}\ s^{-1}$ driven by a servo-hydraulic test machine. During the experiment, the load was recorded by the load cell of the test machine, and used to define the nominal axial stress on the net section of the specimen. The axial extension of the specimen was measured by an extensometer of gauge length 50 mm, and used to determine the nominal axial strain. The measured stress versus strain responses are shown in FIG. 7, while the optical images of the fractured samples are displayed in FIG. 8.

Consider first the results of the 0/90° square lattice. The lattice has a strut-stretching response to the uni-axial tension, and all samples exhibit an initial linear elastic behavior followed by a hardening response, see FIG. 7A. The measured yield stress of the partly SMAT specimen (strategy AII) approximately equals that of the fully SMAT specimen (strategy AI), and is more than threefold higher than that of the no SMAT specimen (strategy N). In contrast, the SMAT samples are less ductile than their no SMAT counterpart. The nominal fracture strains of the fully SMAT, partly SMAT and no SMAT samples are about 11%, 22% and 41%, respectively.

The analysis is applied here to calculate the stress-strain relation of the 0/90° square lattice under uni-axial tension. The horizontal bars a and a' resist directly the applied stretching load along the $x_1$-axis, while the vertical bars b and b' carry negligible forces, see FIGS. 6A and 6B. The bi-linear model of the parent material with and without SMAT is applied to the horizontal bars in order to calculate the nominal axial stress and strain of the lattice. These analytical calculations are included in FIG. 7A. It is clear that in the linear elastic regime, the analytical predictions of Young's modulus and yield strength are in good agreement with the measurements. Also, the partly SMAT strategy AII is as efficient as the fully SMAT strategy AI, and the value of the strengthening factor $k_s=3.5$ is adequate. In the regime of plasticity, the analyses using infinitesimal calculations moderately under-predict the measured $\sigma^*_1$ versus $\varepsilon^*_1$ curves. This can be traced to the under-approximation of the bi-linear material model and the presence of strain concentrations at the nodal positions of the lattice. The fracture locations of the no SMAT specimen are three horizontal bars at the centre of the lattice plate as shown FIG. 8A. In contrast, the fully or partly SMAT specimen fails by a horizontal bar at a corner of the lattice plate, see FIGS. 8B and C.

Now consider the ±45° square lattice. Under the uni-axial load along the $x_1$-axis (FIG. 5B), the lattice exhibits an initial strut-bending deformation mode including a linear elastic behavior followed by a hardening response, see FIG. 7B. At intermediate strain such that $\varepsilon^*_1>5\%$, the lattice starts switching to a strut-stretching deformation mode where the measured stress $\sigma^*_1$ increases considerably with increasing strain $\varepsilon^*_1$. It is evident that in the initial bending-dominated regime, the partly SMAT specimen (strategy AIII) has an almost identical stress-strain curve as the fully SMAT specimen (strategy AI). Thus, this confirms the analytical prediction that strategy AIII is as efficient as strategy AI. For a given value of strain in the bending-dominated regime ($\varepsilon^*_1<5\%$), the corresponding measured stress of strategy AI or AIII is about twice that of strategy N (no SMAT).

Figure 7B:
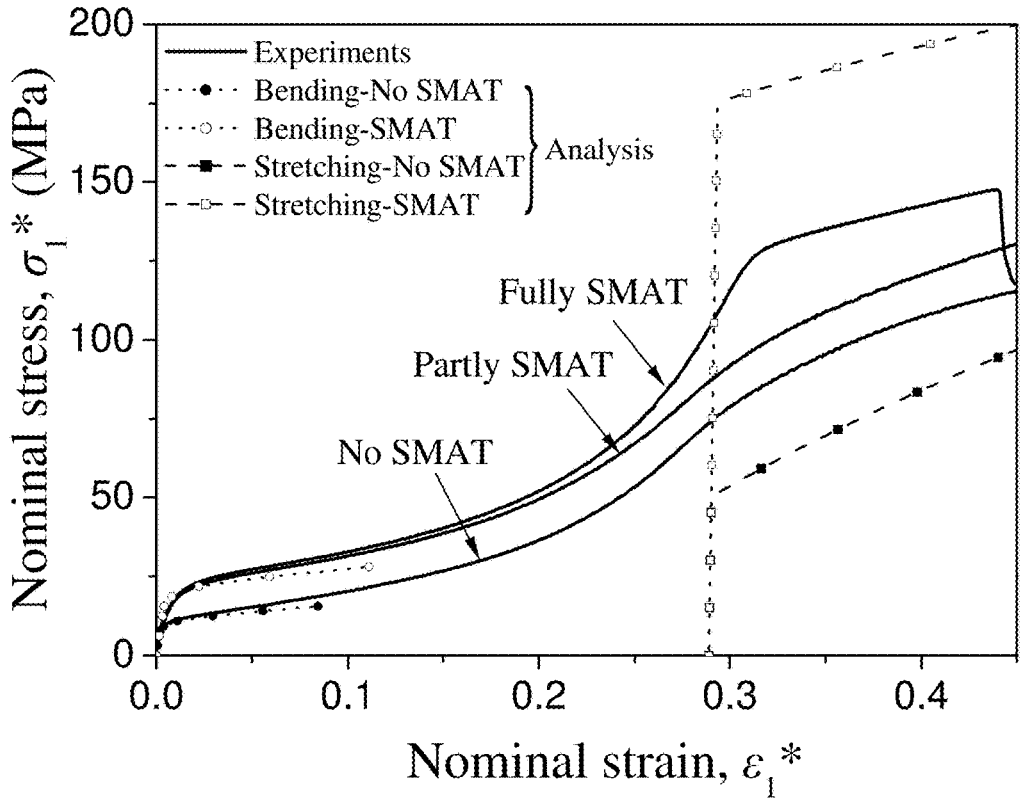
Figure 8:
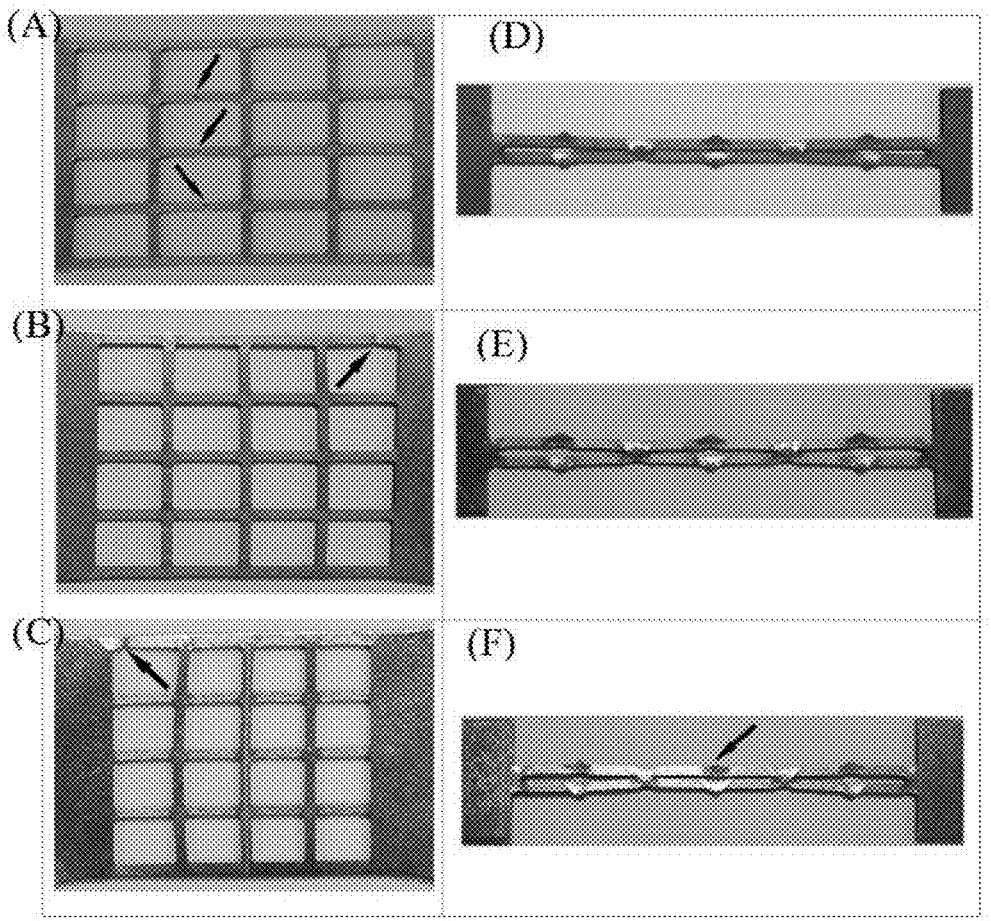
FIGS. 8A-C show fractured 0/90° square lattice specimens with no SMAT—strategy N, partly SMAT—strategy AII, and fully SMAT—strategy AI respectively according to an embodiment of the presently claimed invention.
FIGS. 8D-F show deformed ±45° square lattice specimens with no SMAT—strategy N, partly SMAT—strategy AIII, and fully SMAT—strategy AI respectively according to an embodiment of the presently claimed invention.

Deformation analyses using infinitesimal calculations are also included in FIG. 7B for both bending-dominated and stretching-dominated regimes of the ±45° square lattice. More details of the analytical calculations are described later with the main results summarized here. In the initial strut-bending regime, each bar member is modeled as a beam undergoes bending and the beam material follows the bi-linear description. For the no SMAT specimen, the stress-strain relation of the material is described with $E_s$=200 GPa, $\varepsilon_y$=0.001 and $E_t$=2 GPa. For the fully SMAT specimen, the material stress-strain relation follows with parameters taken as $E_s$=200 GPa, $\varepsilon_y$=0.001, $k=k_b=2$ and $E_t^{SMAT}$=2 GPa. Here, the values of $k_b$ and $E_t^{SMAT}$ are obtained by curve-fitting the analytical model with the measured data. Thus, the SMAT strengthening factor $k_b$=2 of the ±45° square lattice is much smaller than that of the 0/90° square lattice $k_s$=3.5.

In the final stretching-dominated regime of the ±45° square lattice specimen, the material properties in the analytical model are taken as those of the 0/90° square lattice specimen. It is shown in FIG. 7B that the calculated stress-strain relation of the no SMAT specimen under-predicts the measured result. In contrast, the analytical prediction of the fully SMAT specimen over-predicts the measurement. These discrepancies can be traced to the simple assumptions in the analysis neglecting the high level of non-linearities due to material and geometry at the stage of large deformations. Nevertheless, the analysis somewhat gives a reasonable estimation of the switch in the deformation mode of the ±45° square lattice from bending to stretching.

Kagome lattices: horizontal and vertical directions, are tested and studied as follows.

SMAT strategies are selected to apply to each unit cell of the Kagome lattice as follows.

(i) Strategy Ø: no SMAT, as for comparison purposes.

(ii) Strategy BI: SMAT is applied to all bar members of the lattice, see FIG. 9A.

Figure 9:
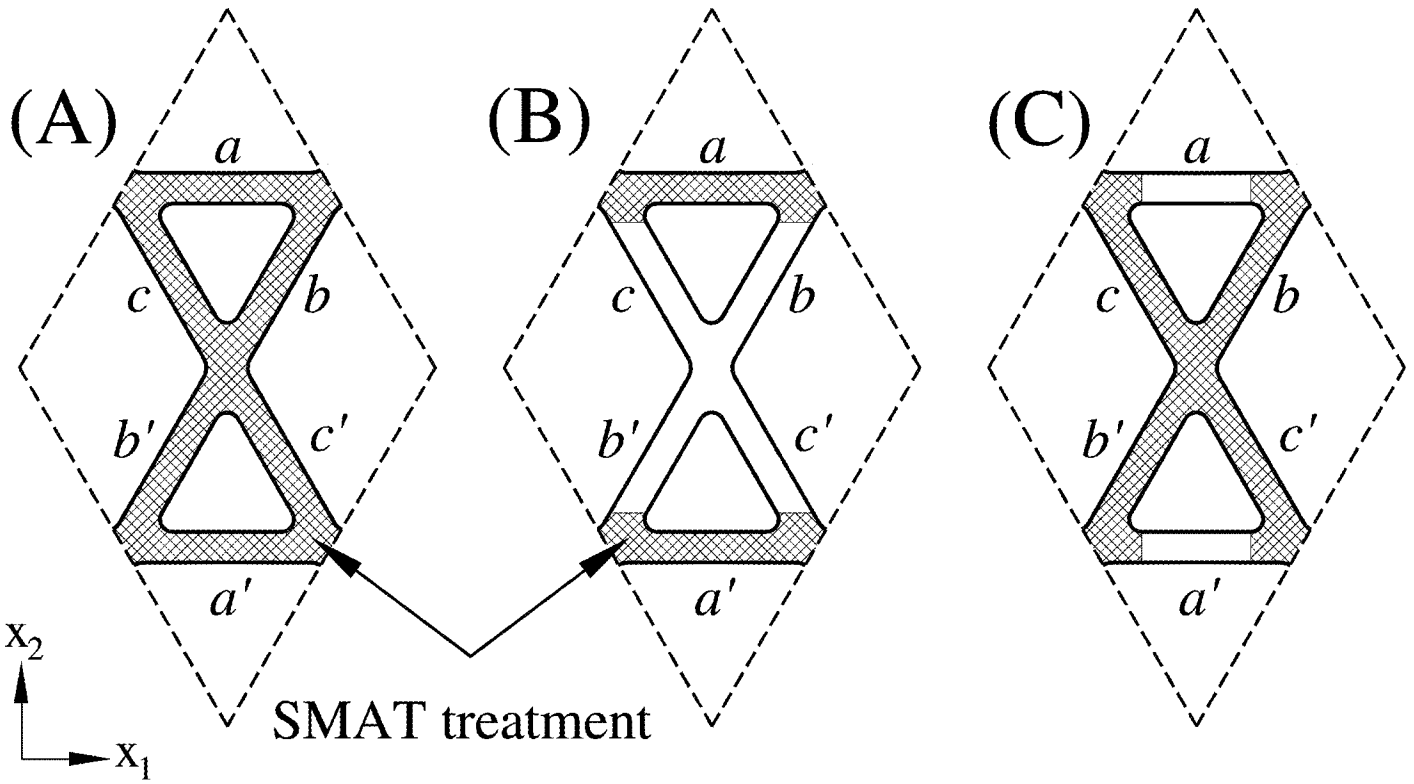
FIGS. 9A-C show SMAT for each unit cell of the Kagome lattice with strategy BI, strategy BII, and strategy BIII.

(iii) Strategy BII: only the two horizontal bars a and a' are treated with SMAT, see FIG. 9B. This strategy is aimed for the loading case of uni-axial tension along the $x_1$-axis where the two horizontal bars are directly subjected to the maximum axial stresses.

(iv) Strategy BIII: only the four diagonal bars b, b', c and c' are SMAT-treated, see FIG. 9C. The strategy is for the uni-axial tension along the $x_2$-axis of the lattice. In this loading case, the four diagonal bars have the maximum axial stresses.

Figure 10:
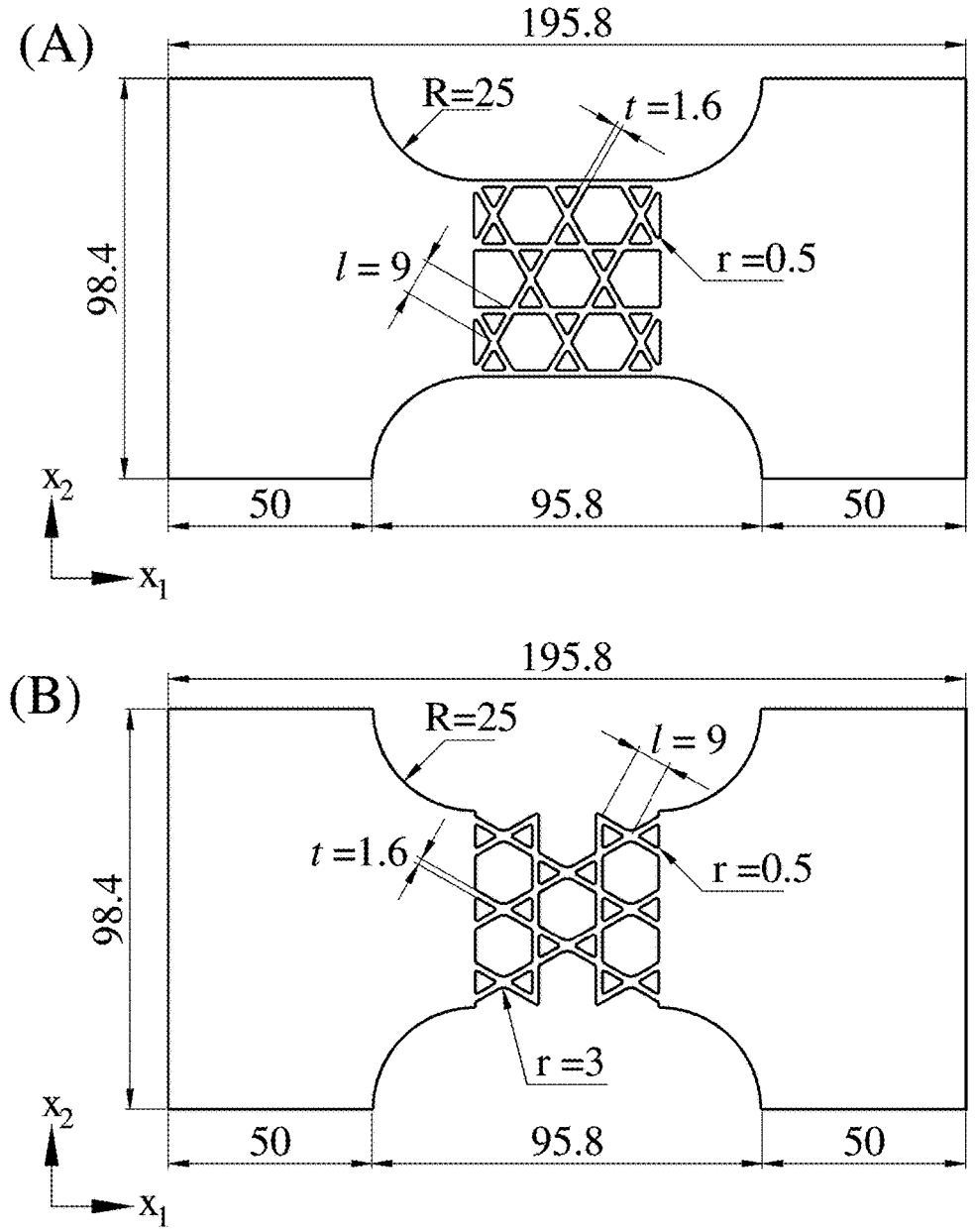
FIGS. 10A-B show geometries of a horizontal Kagome specimen and a vertical Kagome lattice specimen respectively according to an embodiment of the presently claimed invention.

Geometries of the horizontal and vertical Kagome lattice specimens are shown in FIGS. 10A and 10B, respectively. As for the square lattice, each bar member in the Kagome lattice is designed to be of length l=9 mm and width t=1.6 mm, giving the relative density $\bar{\rho}=\sqrt{3}(t/l)=0.30$ for both horizontal and vertical Kagome specimens.

Figure 11:
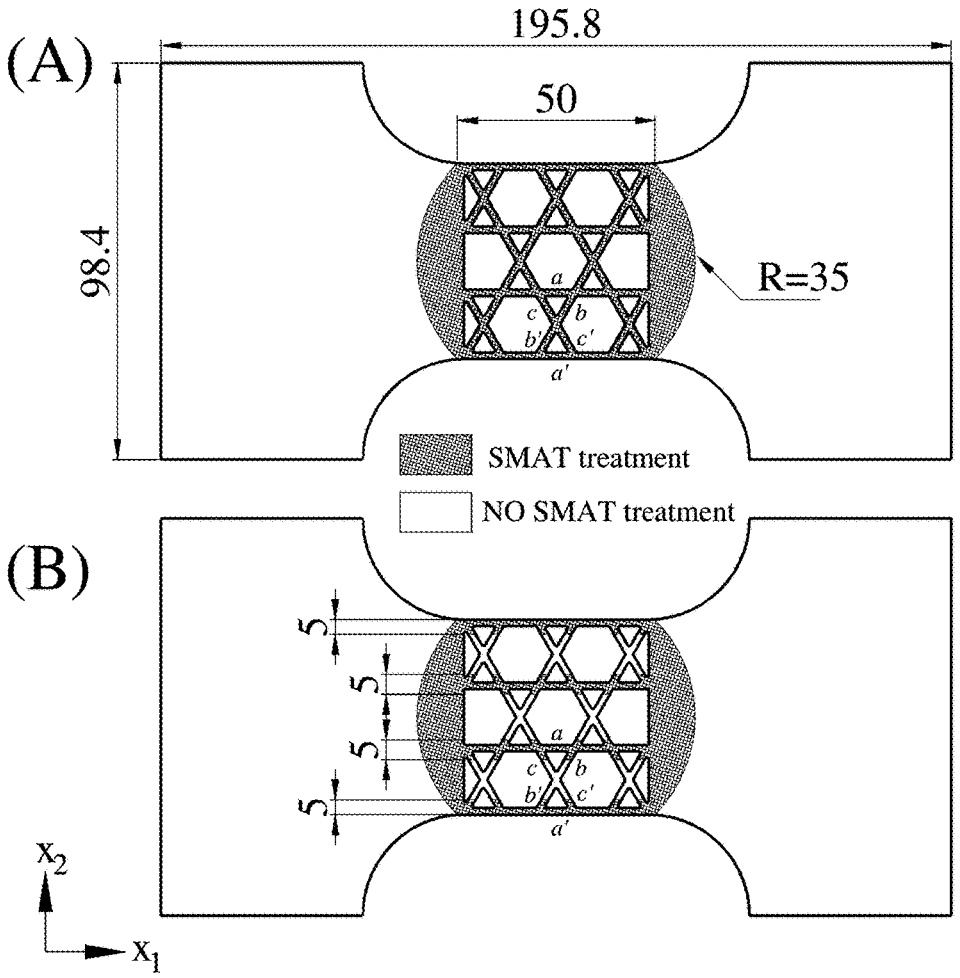
FIGS. 11A-B show two horizontal Kagome lattices with fully SMAT—strategy BI, and partly SMAT—strategy BII respectively according to an embodiment of the presently claimed invention.
FIGS. 11C-D show two vertical Kagome lattices with fully SMAT—strategy BI, and partly SMAT—strategy BIII respectively according to an embodiment of the presently claimed invention.
Figure 11:
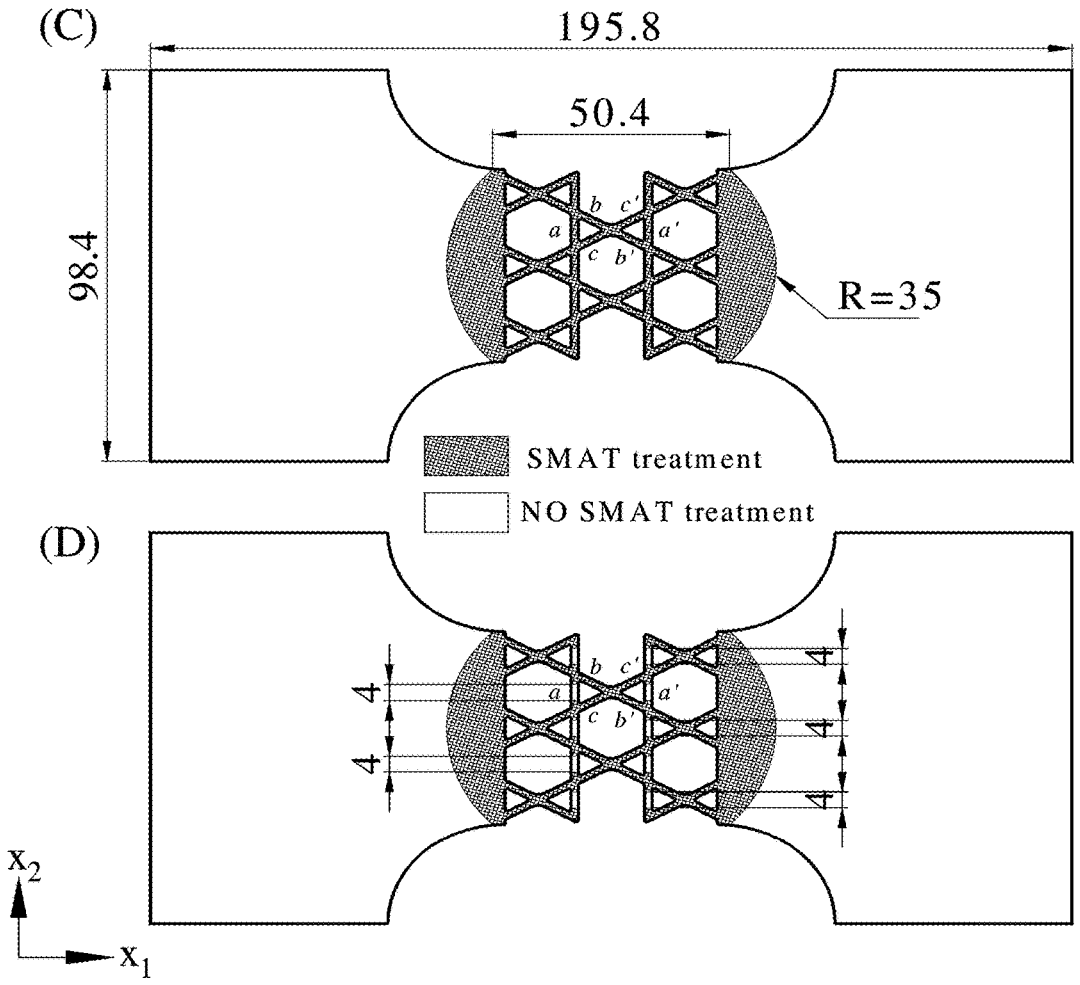

Three identical horizontal Kagome specimens were manufactured for three cases considered: no SMAT—strategy Ø, fully SMAT—strategy BI, and partly SMAT—strategy BII. The SMAT areas are shown in FIG. 11A for strategy I, and in FIG. 11B for strategy BII. Likewise, the vertical Kagome samples were made for three cases: no SMAT—strategy Ø, fully SMAT—strategy BI, and partly SMAT—strategy BIII. The SMAT-treated surface areas of strategies BI and BIII are shown in FIGS. 11C and D, respectively.

The manufacturing and testing processes of the 0/90° square lattice specimens were repeated for all Kagome lattice samples. These Kagome plates were also cut from AISI 304 stainless steel sheets of thickness d=1 mm. The SMAT duration was 3 minutes for all samples, and the untreated surface areas of the partly SMAT specimens were protected by cloths during the treatment process. The servo-hydraulic test machine and the extensometer of gauge length 50 mm were used to measure the nominal stress and strain of the Kagome specimens. The measured results are shown in FIG. 12, while the optical images of the fractured samples are displayed in FIG. 13.

Figure 12A:
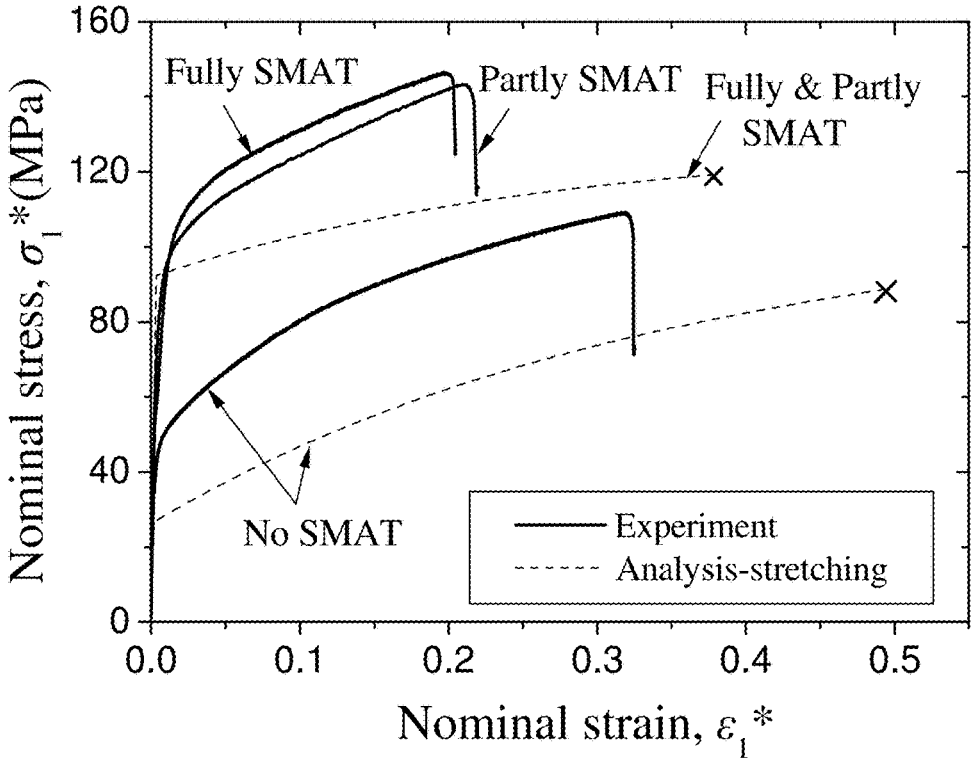
FIGS. 12A-B shows measured responses of the horizontal Kagome lattice specimens and the vertical Kagome lattice specimens respectively with respect to the Kagome lattices of FIGS. 11A-D.
Figure 12B:
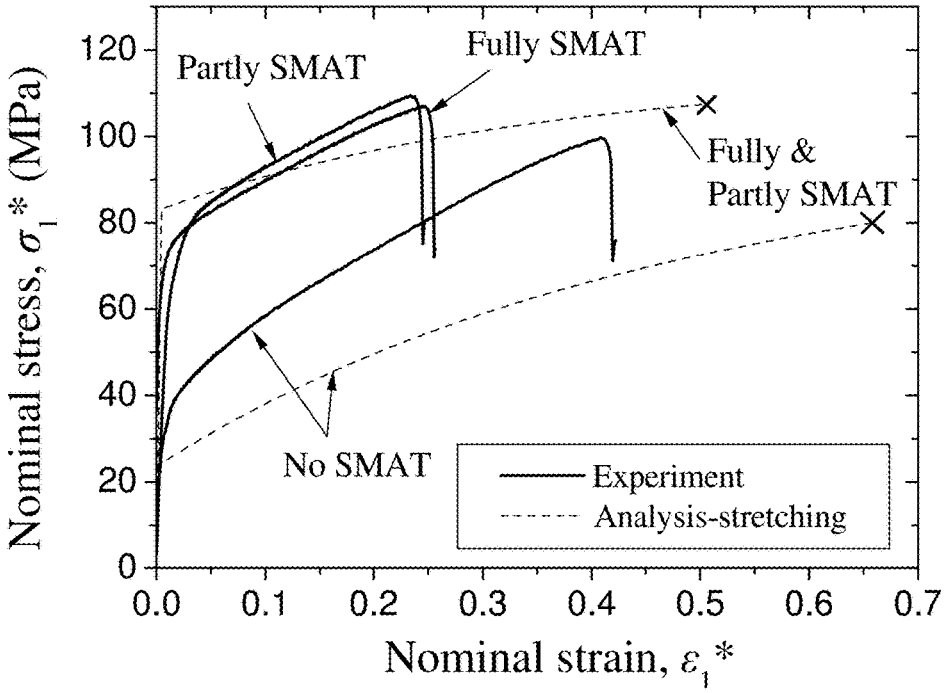
Figure 13:
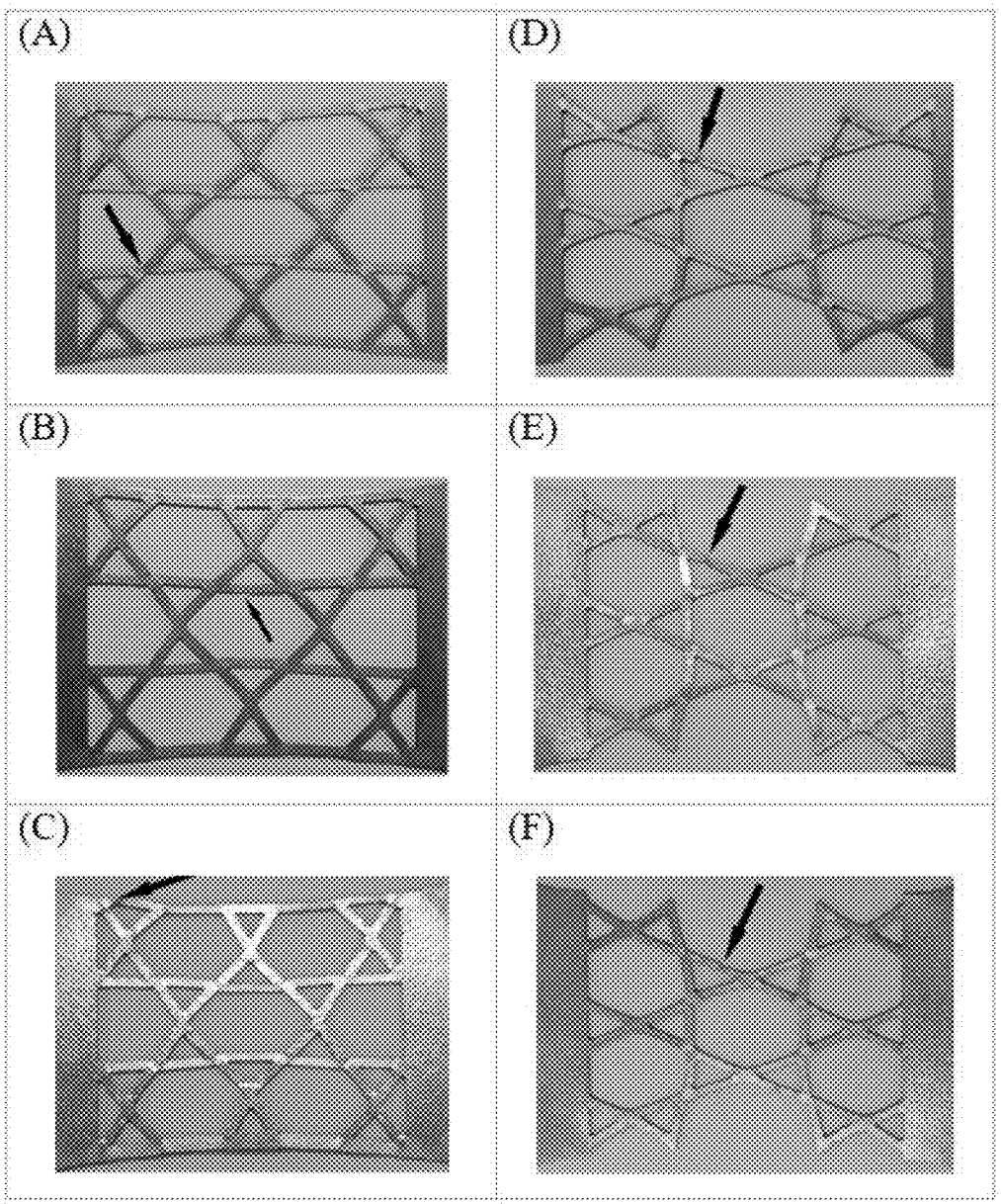
FIGS. 13A-C show fractured horizontal Kagome lattice specimens with no SMAT—strategy Ø, partly SMAT—strategy BII, and fully SMAT—strategy BI respectively according to an embodiment of the presently claimed invention.
FIGS. 13D-F show fractured vertical Kagome lattice specimens with no SMAT—strategy Ø, partly SMAT—strategy BIII, and fully SMAT—strategy BI respectively according to an embodiment of the presently claimed invention.

The Kagome lattice is a stretching-governed structure, so both horizontal and vertical Kagome plates exhibit an initial linear behavior, followed by a hardening response, see FIGS. 12A and B. The stress-strain responses of the partly SMAT specimens in the two orientations are almost identical to those of the fully SMAT specimens. The fracture strains of the partly and fully SMAT specimens are about two thirds that of the no-SMAT specimen for both horizontal and vertical Kagome lattices. Thus, this demonstrates the reduction of material ductility due to the SMAT process.

The analytical predictions using infinitesimal calculations are also included in FIG. 12. First, consider in more detail the horizontal Kagome. The analysis shows that the tension loads along the $x_1$-axis in FIGS. 11A and B are carried by the stretching response of the horizontal bars (a and a'), while the diagonal bars (b, b', c and c') carry negligible forces. This is demonstrated by the experiments where the horizontal Kagome samples fail by the fracture of horizontal bars in various positions as shown in FIGS. 13A, B and C. Thus, apply the bi-linear material description to the horizontal bars in order to calculate the nominal axial stress and strain of the lattice, while neglecting the small effect of the diagonal bars. This simple method gives good predictions within the linear elastic regime for all SMAT and no-SMAT specimens as shown in FIG. 12A. Also, the value of the strengthening factor due to the SMAT process $k_s$=3.5 is adequate. For the plastic regime, the analytical calculations under-predict the measured responses in all cases. This can be explained by the high level of non-linearity due to the strain concentration around nodal positions in the lattice, and the under-approximated bilinear material model.

Last, consider the analysis of the vertical Kagome lattice. As analyzed, the stretching of the diagonal bars (b, b', c and c') is the dominant response to the tension loads along the $x_1$-axis shown in FIGS. 11C and D. This is confirmed by the experiments where all vertical Kagome samples fracture at a diagonal bar at mid-span of the lattice, see FIGS. 13D, E and F. Thus, the bi-linear material model is applied to the diagonal bars to calculate the stress-strain relation of the lattice, while neglecting the small effect of the vertical bars (a and a'). For the SMAT specimens, the predicted yield stress (using the strengthening factor $k_s$=3.5) is slightly higher than the measured value, and the predicted fracture strain is about twice that of the measurement, see FIG. 12B. For the no-SMAT specimen, the analytical calculation is in good agreement with the measurement within the elastic regime, but under-predicts the measured response in the plastic regime. Similar to the 0/90° square and horizontal Kagome lattices, the analytical under-predictions in the plastic regime of the vertical Kagome lattice can be ascribed to the under-approximation of the bilinear material model and the strain concentrations around nodal positions in the lattice.

In the present invention, the strengthening effect of SMAT method is explored for two types of lattices: square and Kagome by analysis and experiment. It is found that the SMAT method is most efficient when it is applied to the locations of high stress concentrations. For bending-dominated structures (the ±45° square lattice under uni-axial tension), the highest reinforcing efficiency is achieved by applying SMAT to the vicinity of bar ends where stresses are most concentrated. In this case, the yield strength of lattice specimens made from 304 stainless steel sheets is increased by a factor of $k_b$=2 through the SMAT process used in the current study. For stretching-dominated structures (the 0/90° square lattice under axial deformation and the Kagome lattice under any macroscopic loading), the strengthening efficiency is maximised when the SMAT is applied over the entire bar members whose axial stresses exceed the elastic limit of the parent materials. In this case, the SMAT strengthening factor upon the yield stress is $k_s$=3.5 for all steel lattice samples tested.

INDUSTRIAL APPLICABILITY

The ability to create structural materials of high yield strength and yet high ductility has been a dream for materials scientists for a long time. The study of mechanical behavior of the surface nanostructured materials using SMAT shows significant enhancements in mechanical properties of the nanostructured surface layer in different materials.

Deformation regimes of the ±45° square lattice under uni-axial tension are discussed as follows.

The ±45° square lattice has two dominant regimes of deformation: (i) the initial strut-bending and (ii) the final strut-stretching. The stress-strain analysis using infinitesimal calculations is performed here for each mode of deformation.

Regime I: Strut-Bending Deformation Mode

Figure 14:
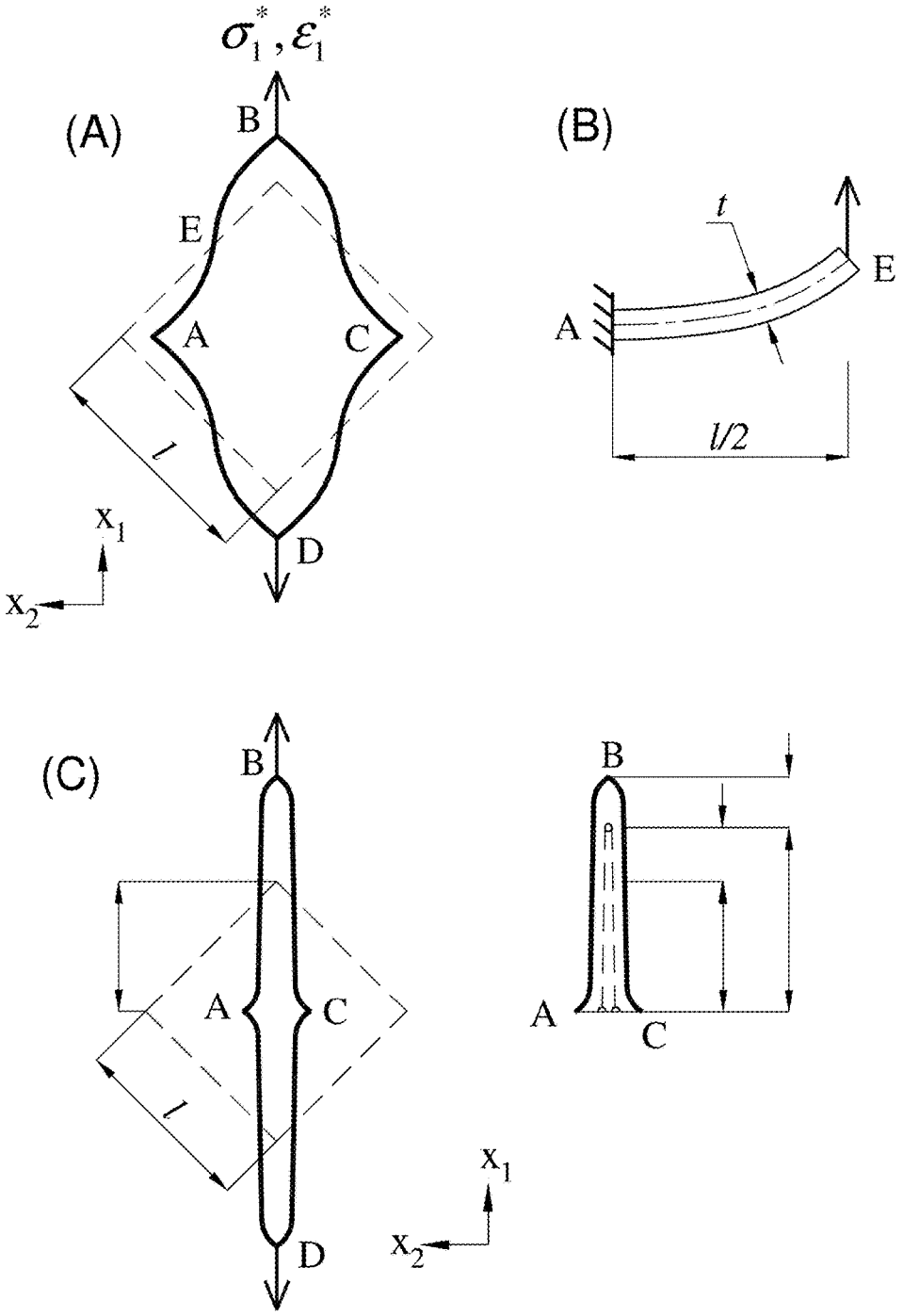
FIGS. 14A-C show uni-axial tension of a ±45° square lattice with an initial bending-dominated regime, a bending of a half of the beam element, and a stretching-dominated regime respectively according to an embodiment of the presently claimed invention.

The initial bar-bending response of the ±45° square lattice to the uni-axial tension load is illustrated in FIG. 14A. The stress-strain relation of the lattice is determined by analyzing the bending of a half of a representative bar member, as sketched in FIG. 14B. The nominal stress of the lattice $\sigma^*_1$ is related to the transverse load P as $$\sigma_1^* = \frac{2P}{dl} \tag{A.1}$$

where d is the depth of the lattice, and l is the length of each bar member. The nominal strain of the lattice $\varepsilon^*_1$ is associated with the tip deflection δ as $$\varepsilon_1^* = \frac{2\delta}{l}. \tag{A.2}$$

Recall from the experiments that d=1 mm is the thickness of the 304 stainless steel sheets, whilst t=1.6 mm and l=9 mm are the width and length of each bar member in the designed lattice specimens. Due to the stubbiness of the bar members, the bar length in our calculations is taken as l'=l−t=7.4 mm.

The inelastic bending of a cantilever beam made from a bi-linear material is analysed by Fertis (1999) using the method of the equivalent systems. The lengthy process of this approximation method is omitted and the reader is referred to Feris (1999) for more details. Here, their methodology to determine the relation of the load P and the tip deflection δ for two cases is applied: the beam is untreated with SMAT, and the beam is fully treated with SMAT. Again, the bi-linear material approximations are applied for these two cases considered. For the no SMAT lattice, the material properties are those of the original steel sheets: $E_s$=200 GPa, $\varepsilon_y$=0.001 and $E_t$=2 GPa. For the fully SMAT lattice, the initial Young's modulus and yield strain are unchanged as $E_s$=200 GPa and $\varepsilon_y$=0.001. The two SMAT parameters are obtained by curve-fitting with the measured data as $k=k_b=2$ and $E_t^{SMAT}$=2 GPa. The nominal stress and strain ($\sigma^*_1$,$\varepsilon^*_1$) of the lattice derived are shown in FIG. 7B for both no SMAT and fully SMAT specimens, and these are in good agreement with the measurements.

Regime II: Strut-Stretching Deformation Mode

Suppose that all nodes in the ±45° square lattice are pin-jointed. Under the infinitesimal tension force, the bar members are pulled from the initial diamond shape into a straight configuration due to the collapse mechanism of the lattice, see FIG. 14C. At this stage, all bars are aligned in the direction of the stretching force along the $x_1$-axis. This is defined as the locking stage as the bars start stretching with increasing applied force. The locking length $h_L$ of a half of the unit cell is $$h_L = h_0 + \Delta h_L = h_0(1+\varepsilon^*_L) \tag{A.3}$$

where $h_0=l/\sqrt{2}$ and the locking strain is $$\varepsilon_L^* = \frac{\Delta h_L}{h_0}. \tag{A.4}$$

The nominal strain of the lattice is determined as $$\varepsilon_1^* = \frac{\Delta h_L + \Delta h}{h_0} = \varepsilon_L^* + \varepsilon\left(\frac{h_L}{h_0}\right) \tag{A.5}$$

where $\varepsilon=\Delta h/h_L$ is the engineering strain of the bar member. The nominal stress of the lattice $\sigma^*_1$ is related to the stretching stress of the bar member σ as $$\sigma_1^* = \frac{\sqrt{2}\,t}{l}\sigma. \tag{A.6}$$

The initial height of the ±45° square lattice specimens is $h_0=l/\sqrt{2}$=6.4 mm. The bar members are relatively stubby, so the locking length is taken as $h_L$=l−t/2=8.2 mm leading to the locking strain $\varepsilon^*_L=h_L/h_0-1$=0.29. The material properties of the specimens are taken as those given: $E_s$=200 GPa, $\varepsilon_y$=0.001 and $E_t$=2 GPa for the no SMAT sample; and $E_s$=200 GPa, $\varepsilon_y$=0.001, $k_s$=3.5 and $E_t^{SMAT}$=1.7 GPa for the fully SMAT sample. The stress-strain relations of the lattice derived are shown in FIG. 7B for both no SMAT and fully SMAT specimens.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

Disclosure of the following references are hereby incorporated by reference in their entirety:

REFERENCE

Chan, H. L., Ruan, H. H., Chen, A. Y., Lu, J., 2010. Optimization of strain-rate to achieve exceptional mechanical properties of 304 stainless steel using high speed ultrasonic SMAT. Acta Mater. 15, 5086-5096.

Chen, A. Y., Ruan, H. H., Wang, J., Chan, H. L., Wang, Q., Li, Q., Lu, J., 2011. The influence of strain rate on the microstructure transition of 304 stainless steel. Acta Mater. 59, 3697-3709.

Fleck, N. A., Deshpande, V. S., Ashby, M. F., 2010. Micro-architectured materials: past, present and future. Proc. R. Soc. Lond. A. 466, 2495-2516.

Gibson, L. J., Ashby, M. F., 1997. Cellular Solids: Structure and Properties, second edition. Cambridge University Press.

Lu, K., Lu, J., 1999. Surface nanocrystallization (SNC) of metallic materials—presentation of the concept behind a new approach. J. Mater. Sci. Technol. 15, 193-197.

Lu, K., Lu, J., 2004. Nanostructured surface layer on metallic materials induced by surface mechanical attrition treatment. Mater. Sci. Eng. A. 375, 38-45.

Lu J., Lu K., 2010. Method for generating nanostructures and device for generating nanostructures. U.S. Pat. No. 7,691,211.

What is claimed is:

1. A nano-structured lattice generated by surface mechanical attrition treatment (SMAT), comprising:

a plurality of bar members having end portions; and one or more holes embedded inside the nano-structured lattice, wherein the lattice is two-dimensional;

wherein one or more of the bar members comprise one or more nodes for connecting one or more other bar members; and wherein one or more of the bar members are partly treated at each of the end portions around the one or more nodes by the SMAT.

2. The lattice of claim 1, wherein a grain size at a surface of the one or more SMAT treated bar members has been reduced to form at least one nano-structured layer with grain size in nanometer after being treated by the SMAT.

3. The lattice of claim 1, wherein the lattice is a square lattice comprising the one or more holes in a square shape, and wherein the one or more holes comprises at least two holes being periodically located along two principal axes of planar space.

4. The lattice of claim 3, one of the two principal axes defining a horizontal axis, wherein the one or more SMAT treated bar members are horizontal bar members for being subjected to an applied loading along the horizontal axis of the square lattice.

5. The lattice of claim 3, wherein the one or more SMAT treated bar members are partly treated at their end portion within a circle around the one or more nodes.

6. The lattice of claim 5, wherein the circle has a radius (R) calculated by:

$$R=(1-1/k)l/2$$

where k is SMAT duration in minutes, and l is length of each bar member in millimeters.

7. The lattice of claim 1, wherein the one or more SMAT treated bar members are treated by the SMAT based on being subjected to a maximum axial stress.

8. The lattice of claim 7, wherein the maximum axial stress is uniaxial.

* * * * *